US007225567B1

(12) United States Patent
Cunningham et al.

(10) Patent No.: US 7,225,567 B1
(45) Date of Patent: Jun. 5, 2007

(54) DISPLAY APPARATUS FOR VISUALLY COMMUNICATING INFORMATION PERTAINING TO A WORKER'S WHEREABOUTS

(76) Inventors: Audrey Cunningham, 309 Silver Beach Rd., Lake Park, FL (US) 33403; Walter Cunningham, 309 Silver Beach Rd., Lake Park, FL (US) 33403

( * ) Notice: Subject to any disclaimer, the term of this patent is extended or adjusted under 35 U.S.C. 154(b) by 268 days.

(21) Appl. No.: 10/824,306

(22) Filed: Apr. 13, 2004

(51) Int. Cl.
*G09F 1/00* (2006.01)

(52) U.S. Cl. ..... 40/124.12; 40/907; 402/73; D6/518

(58) Field of Classification Search ..... 40/107–120, 40/358, 641; 283/2–4; 434/304, 394; D10/124, D10/122, 3; 402/76, 75, 73
See application file for complete search history.

(56) References Cited

U.S. PATENT DOCUMENTS 1,659,395 A * 2/1928 Douglas ..... 402/70
D80,019 S * 12/1929 Clark ..... D10/3
D91,541 S * 2/1934 Pedersen ..... D6/518
2,014,863 A * 9/1935 Rollnick et al. ..... 40/117
D250,201 S * 11/1978 Pierce ..... D19/23
4,696,118 A * 9/1987 Cross ..... 40/120
4,708,490 A * 11/1987 Arber ..... 368/28
4,740,932 A * 4/1988 Cephas et al. ..... 368/28
4,985,393 A * 1/1991 Seyama et al. ..... 503/216
5,030,027 A * 7/1991 Bachrach et al. ..... 402/4
5,038,505 A * 8/1991 Young ..... 40/358
5,379,979 A * 1/1995 Due ..... 248/441.1
5,537,369 A * 7/1996 Wu ..... 368/10

FOREIGN PATENT DOCUMENTS

JP 2004163289 A * 6/2004

* cited by examiner

*Primary Examiner*—Cassandra Davis
(74) *Attorney, Agent, or Firm*—Gold & Rizvi, P.A.; Glenn E. Gold; H. John Rizvi

(57) ABSTRACT

A display apparatus for use by a worker in a workplace environment to visually communicate to coworkers, among other things, the current location or whereabouts of the worker and the worker's expected time of return to an office or other workspace. Cards carried by a spiral member of the apparatus include alphanumeric and/or pictorial information to quickly indicate a location within the workplace. A clock face having manually adjustable hands indicates an expected return time. One embodiment incorporates a triangular geometry geared for support on a desktop. Additional embodiments are configured for positioning over an office partition wall, as well as against an office door panel, window and the like.

1 Claim, 3 Drawing Sheets

DISPLAY APPARATUS FOR VISUALLY COMMUNICATING INFORMATION PERTAINING TO A WORKER'S WHEREABOUTS

FIELD OF THE INVENTION

The present invention relates generally to non-electronic displays for visually communicating information pertaining to the whereabouts of a person in a workplace environment. More particularly, the present invention relates to various configurations of such an apparatus incorporating a clock face having manually-adjustable clock hands, a series of display panels containing pictorials and/or alphanumeric text and, preferably, at least one marking section, together indicating the location of a worker, and his or her expected return time to an office space.

DESCRIPTION OF THE PRIOR ART

Many workplace environments are quite large and employ a great number of workers. In some workplaces, workers are provided with portable electronic communications equipment, such as pagers, two-way radios, mobile telephones and the like, thereby providing workers with means for determining the whereabouts of one another during the workday. However, in the vast majority of workplace environments, employers are unable to provide such equipment to workers due, for example, to cost constraints.

In most workplaces, it is common for a worker to walk over to the office space of co-workers to discuss work-related matters, such as a co-assignment. In those cases where workers do not have the luxury of being provided with portable electronic communications devices, if the co-worker is not residing within his office space, there is generally no efficient way of determining where the co-worker has gone, nor when he or she will be returning to the office space. Consequently, this can result in inefficiencies, for example, in trying to coordinate a last minute meeting.

One solution to this problem is for workers to leave a message, for example, in the form of a handwritten note or on an erasable marker board to indicate where they have gone and approximately when they plan on returning. However, this is a time-consuming and generally inefficient approach and, consequently, most workers are not willing to take the time prepare such a message. Furthermore, workers that do prepare such notes often leave them in very inconspicuous locations that are likely to be overlooked by a co-worker searching for there whereabouts.

Accordingly, it would be desirable to provide an inexpensive, non-electrical display apparatus that can be easily displayed within the office space of a worker, incorporating easily manipulated components for communicating information indicating at least the whereabouts of an absent worker and the expected return time of the worker to his or her office space. Preferably, the display apparatus should incorporate an aesthetically-pleasing appearance and a construction enabling the display to be prominently exhibited on a work surface, such as a desk, suspended from the wall of a cubicle or similar office space structure, or attachable directly to an office wall, door, window or the like.

SUMMARY OF THE INVENTION

The invention is generally directed to a display apparatus for use by a worker in a workplace environment, wherein the display can be used to visually communicate, among other things, the current whereabouts of the worker and the worker's expected time of return to a workspace.

In a first general embodiment of the invention, the display apparatus is particularly designed for use on a support surface of office furniture, such as a desktop, hutch or the like, and comprises:

a triangular support structure having a base, a rear panel and a front panel, the front and rear panels adjoined at an upper edge, the display apparatus particularly adapted for being supported upon a desktop surface;

a plurality of cards each having information contained thereon pertaining to a worker location;

a spiral member extending through apertures in an upper end of the cards and through corresponding apertures extending through the front and rear support structure panels adjacent to the upper edge, the cards being carried by the spiral member; and a clock face disposed upon the front panel of the support structure adjacent to the plurality of cards, the clock face having manually adjustable clock hands.

In another aspect of this first embodiment of the invention, an erasable writing surface is provided disposed upon the front panel of the support structure adjacent to the plurality of cards, for use with an erasable marker.

In a further aspect of the invention, the information contained on the plurality of cards further comprises pictorials indicating a worker location. At least one of the cards may incorporate an erasable writing surface thereon to enable the worker to selectively provide additional card information.

In a second general embodiment of the invention, the display apparatus is particularly designed for being hung over an office partition wall, such as a cubicle partition wall, and comprises:

a rectangular panel having an upper edge, a lower edge, a left side edge, a right side edge and a front surface;

at least one hooked member secured to said rectangular panel and configured for releasable engagement with an upper edge of an office partition panel for hanging the display apparatus therefrom;

a plurality of cards each having information contained thereon pertaining to a worker location;

a spiral member extending through apertures adjacent to an edge of the cards and through corresponding apertures extending through the rectangular panel adjacent said lower edge along a central panel portion, the cards being carried by the spiral member; and a clock face disposed upon the front surface of the rectangular panel adjacent to one of the rectangular panel side edges, the clock face having manually adjustable clock hands.

In another aspect of this second embodiment of the invention, means are provided for enabling consecutively carried cards to be releasably secured to each other including, for example, integrated magnetic portions and hook-and-loop type fastening system components.

In a further aspect of the second embodiment of the invention, an erasable writing surface is provided disposed upon the front surface of the rectangular panel adjacent to one of the rectangular panel side edges, for use with an erasable marker.

In a yet another aspect of the second embodiment of the invention, the information contained on the plurality of cards further comprises pictorials indicating a worker location. At least one of the cards may incorporate an erasable writing surface thereon to enable the worker to selectively provide additional card information.

In a third general embodiment of the invention, the display apparatus is particularly designed for being releasably secured directly to a vertical surface of an office wall or door panel, and comprises:

a rectangular panel having an upper edge, a lower edge, a left side edge, a right side edge, a front surface and a rear surface;

means disposed on said rear surface for releasably attaching said rectangular panel to a door panel;

a plurality of cards each having information contained thereon pertaining to a worker location;

a spiral member extending through apertures adjacent to an edge of the cards and through corresponding apertures extending through the rectangular panel and running horizontally between the left and right side edges proximate to the lower edge, the cards being carried by the spiral member; and a clock face disposed upon the front surface of the rectangular panel adjacent to the upper edge of the rectangular panel, the clock face having manually adjustable clock hands.

In another aspect of this third embodiment of the invention, means are provided for enabling consecutively carried cards to be releasably secured to each other including, for example, integrated magnetic portions and hook-and-loop type fastening system components.

In a further aspect of the third embodiment of the invention, an erasable writing surface is provided disposed upon the front surface of the rectangular panel adjacent to the lower edge, for use with an erasable marker.

In a yet another aspect of the third embodiment of the invention, the information contained on the plurality of cards further comprises pictorials indicating a worker location. At least one of the cards may incorporate an erasable writing surface thereon to enable the worker to selectively provide additional card information.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to a display apparatus for use by a worker in a workplace environment, wherein the display can be used to visually communicate, among other things, the current whereabouts of the worker and the worker's expected time of return to an office or other workspace. Various configurations of the display apparatus are provided to enable the display to be supported upon a desktop, or other furniture support surface, hung over an upper edge of an office partition, such as a cubicle partition, or directly secured to a vertical surface of an office wall or door panel. The various embodiments of the display apparatus incorporate a relatively simple design lending itself to cost-effective manufacturing.

Figure 1:
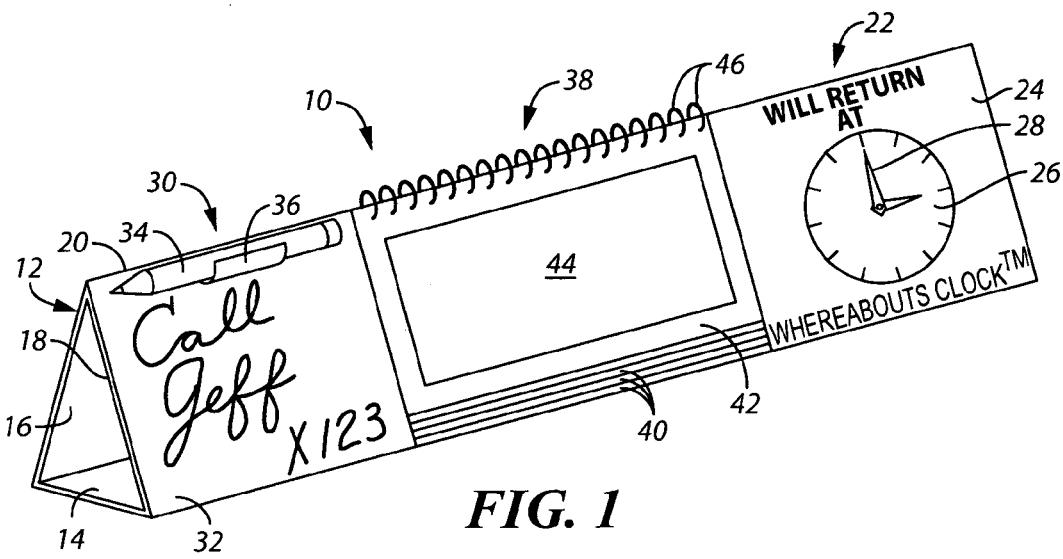
FIG. 1 is a perspective elevation view of a display apparatus configured for being supported on a work surface, such as a desktop, in accordance with one embodiment of the present invention.

Referring initially to FIG. 1, in a first embodiment of the invention a visual display apparatus, shown generally as reference numeral 10, is particularly configured for being supported upon a desktop or similar furniture support surface (not shown) within an office or other workspace. The apparatus has a horizontally elongated triangular main body 12 including a base panel 14, a rear panel 16 and a front panel 18. The rear panel 16 and front panel 18 meet at a common upper edge, or apex 20.

A right portion 22 of the main body 12 includes an outer surface 24 having a clock face 26 disposed thereon. Preferably, the clock face 26 is either directly printed on surface 24 or, alternatively, comprises a preprinted adhesive label. A pair of manually adjustable clock hands 28 are provided and can be set by a worker to indicate an estimated time of return to the work space.

A left portion 30 of the main body 12 includes an erasable marking surface 32, as is well known in the art, for enabling information to be marked thereon. Preferably, an erasable marker 34 is provided secured within a cradle 36 or other marker holding structure proximate to marking surface 32. The marking surface 32 and marker 34 provide means for the worker to leave additional information relating their whereabouts, as well as means for co-workers stopping by the workers office to leave a message.

Figure 4A:
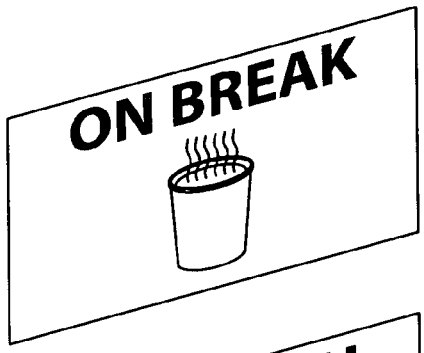
FIGS. 4*a*-4*e* are schematic illustrations of exemplary display signs, incorporating pictorials and/or alphanumeric text, for use with any of the displays embodied in FIGS. 1 through 3.
Figure 4B:
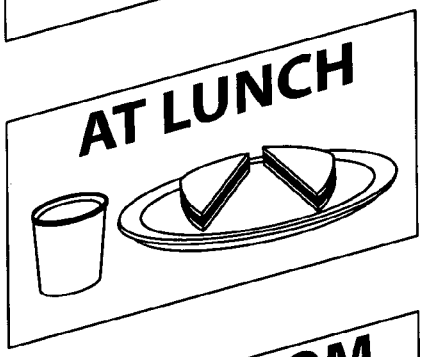
Figure 4C:
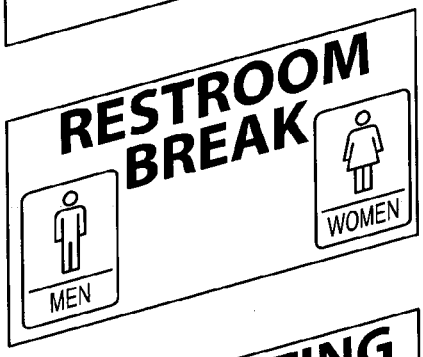
Figure 4D:
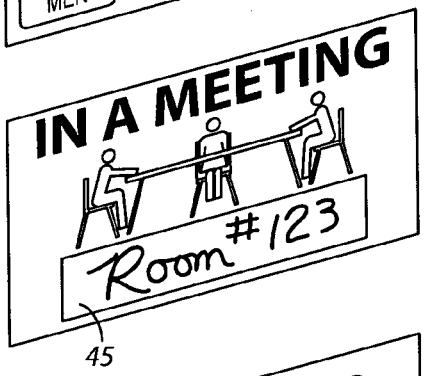
Figure 4E:
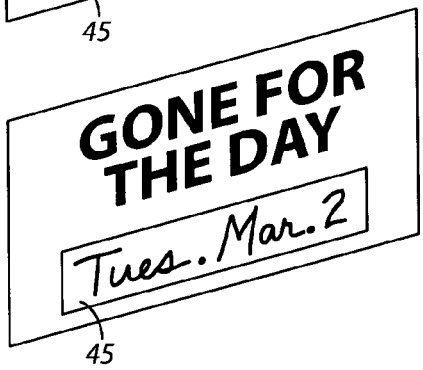

A middle portion 38 of the main body 12 includes a plurality of informational cards 40 carried by a horizontally disposed spiral member 46. Each card 40 includes a message, preferably at least partially in the form of a pictorial, within a region 44 of its front surface 42. Some exemplary pictorials are illustrated in FIGS. 4*a*–4*e*, and generally incorporate symbolic pictorials specifically indicating a particular location within the workplace. Preferably, at least one pictorial (FIG. 4*e*) is provided to indicate that the worker is outside of the workplace. As shown in FIGS. 4*d* and 4*e*, the pictorials can incorporate an area 45 having an erasable marking surface similar to marking surface 32, to enable the worker to add further information pertaining to their whereabouts. Preferably, the card messages, including both alphanumeric text and pictorial information, is directly printed upon the front surface 42 of each card 40. Alternatively, the messages can be provided on preprinted adhesive labels adhered within region 44 of card surface 42. As will be apparent to those skilled in the art, other card structures and configuration are possible and are considered within the scope of the present invention. For example, in lieu of directly printing the messages (FIGS. 4*a*–4*e*) on surface 42, or adhering adhesive labels containing the messages thereon, the applicants contemplate using planar magnets (not shown), similar to conventional refrigerator magnets, having the messages disposed thereon. In that case, region 44 of surface 32 would be provided having a surface adapted for attracting the magnets thereto.

Figure 2:
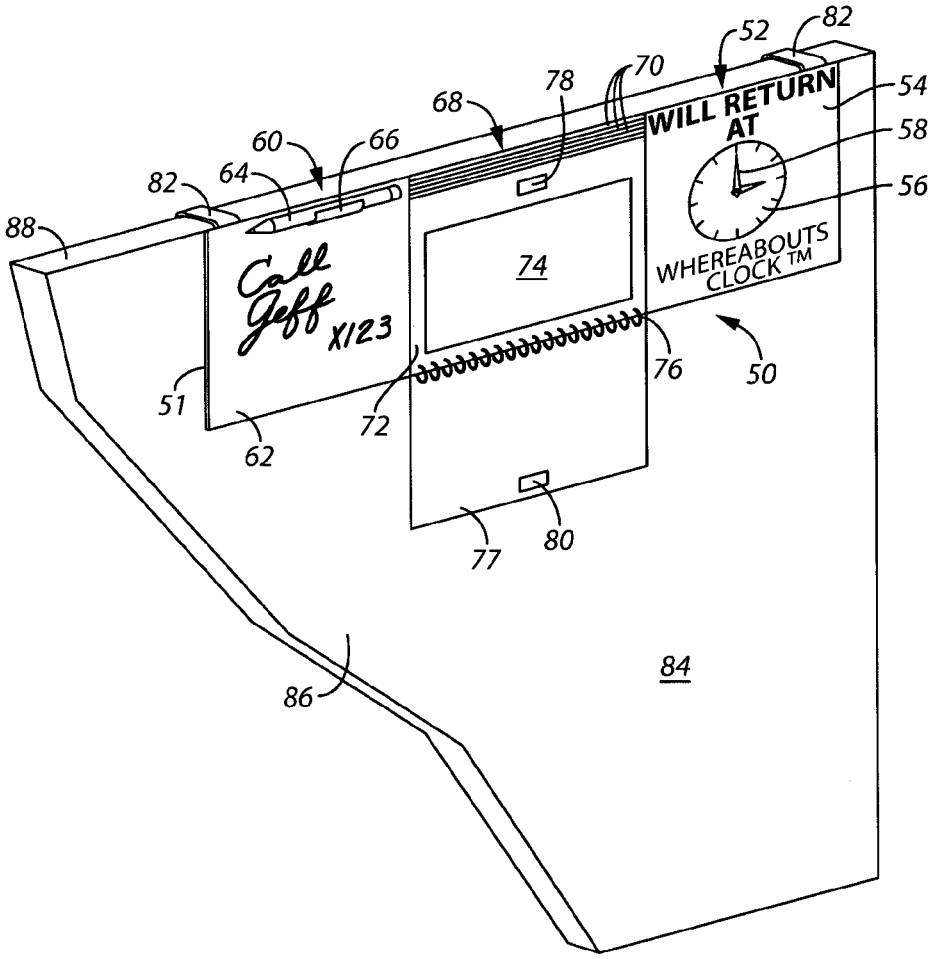
FIG. 2 is a perspective elevation view of a display apparatus configured for being suspended from the wall of a cubicle or like office space structure, in accordance with a second embodiment of the present invention.

Referring now to FIG. 2, in a second embodiment of the invention a visual display apparatus, shown generally as reference numeral 50, is particularly configured for being hung from an upper edge 88 of an office partition wall 84, such as a conventional cubicle wall, such that the apparatus is maintained substantially flush with a main partition wall surface 86. The apparatus has a generally planar horizontally elongated rectangular main body 51 and includes a right portion 52, a left portion 60 and a middle portion 68, generally corresponding to the right portion 22, left portion 30 and middle portion 38 of the display apparatus described heretofore with respect to FIG. 1.

Right portion 52 of main body 51 includes an outer surface 54 having a clock face 56 disposed thereon, and a pair of manually adjustable clock hands 58 as previously described with respect to FIG. 1. Likewise, left portion 60 of main body 51 includes an erasable marking surface 62, and an erasable marker 64 secured within a cradle 66 or other marker holding structure proximate to marking surface, as previously described with respect to FIG. 1.

A middle portion 68 of the main body 51 includes a plurality of informational cards 70 carried by a horizontally disposed spiral member 76, proximate a lower edge of the main body. Each card 40 includes a message, preferably at least partially in the form of a pictorial, within a region 74 of its front surface 72, as exemplified in FIGS. 4*a*–4*e*, and described heretofore with respect to FIG. 1. Preferably, consecutively positioned carried cards incorporate means for being releasably secured to each other. Particularly, an area 78 on the front surface 72 of each of the cards 70 is provided with means for being releasably secured to a corresponding area 80 on the rear surface 77 of a consecutively positioned one of the cards 70. Preferably, areas 78 and 80 are provided having magnetic portions to achieve the desired releasable securing. For example, magnetic strips or the like, as are well known and commercially available, can be attached or otherwise integrated into the respective areas 78, 80 of the cards. Alternatively, mating portions of a hook-and-loop type fastening system, such as that sold under the trade name VELCRO, could be disposed within card areas 78 and 80.

A pair of brackets 82, or hooks, attached to opposite ends of the main body 51 of the display apparatus 50, enable hanging of the apparatus over the upper edge 88 of partition wall 84. In this manner, the display apparatus is maintained against a wall surface 86, such as the outer wall of a cubicle, to visually indicate the whereabouts of a worker to coworkers passing by the worker's cubicle.

Figure 3:
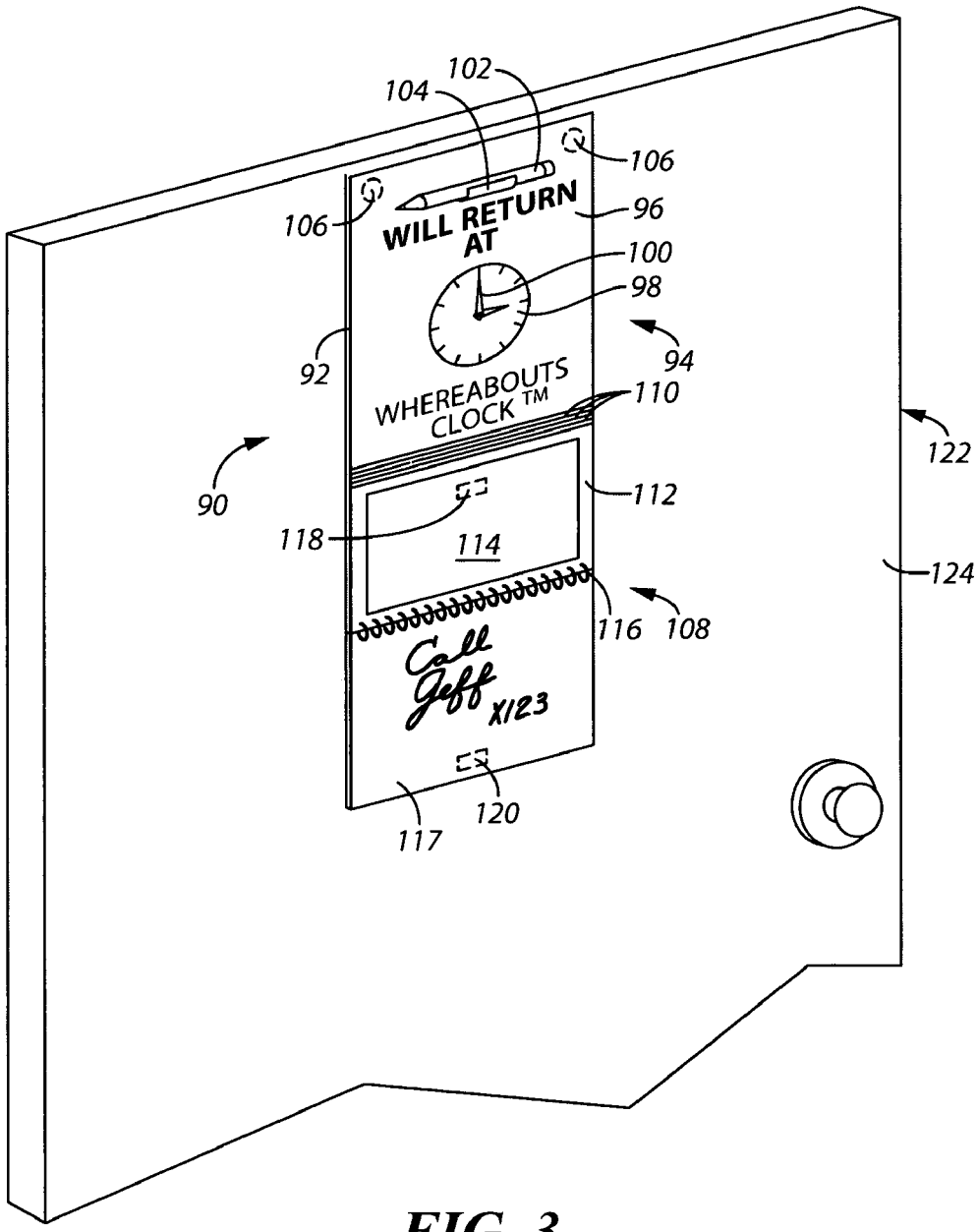
FIG. 3 is perspective elevation view of a display apparatus configured for being directly secured to a vertical wall, door, window or like office space structure, in accordance with a third embodiment of the present invention.

Referring now to FIG. 3, in a third embodiment of the invention a visual display apparatus, shown generally as reference numeral 90, is particularly configured for being directly secured to the surface of a vertical office structure. In FIG. 3, and the accompanying description, the apparatus is described with respect to a door panel 122 for convenience. However, as will be apparent to those skilled in the art, the apparatus is adapted for attachment to any vertical structure surface including, for example, an office window or wall.

The apparatus 90 includes has a generally planar vertically elongated rectangular main body 92 and includes an upper portion 94 and a lower portion 108. Upper portion 94 of main body 92 includes an outer surface 96 having a clock face 98 disposed thereon, and a pair of manually adjustable clock hands 100 as previously described with respect to FIGS. 1 and 2.

Lower portion 108 includes a plurality of informational cards 110 carried by a horizontally disposed spiral member 116 extending through apertures in the main body 92 and corresponding apertures in the cards 110. Each card 110 includes a message, preferably at least partially in the form of a pictorial, within a region 114 of its front surface 112, as exemplified in FIGS. 4*a*–4*e*, and described heretofore with respect to FIGS. 1 and 2. Preferably, consecutively positioned carried cards incorporate means for being releasably secured to each other, via card areas 118 and 120, as previously described, and shown in FIG. 2, with respect to the second embodiment of the invention. Additionally, each card is preferably provided having a rear erasable marking surface 117, and an erasable marker 102 secured within a cradle 104, integrated into the upper region 94 of the display apparatus, as previously described with respect to FIGS. 1 and 2.

Securing means 106 are provided attached to the rear surface, proximate the upper end, of main body 92 to enable releasable attachment of the display apparatus 90 to the surface 124 of door panel 122, to visually indicate the whereabouts of a worker to coworkers passing by the worker's office. The securing means 106 can include, but are not limited to, suction cups, magnets and adhesive tape.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A portable display apparatus for communicating information pertaining to the whereabouts of a worker within a workplace environment, comprising:

a triangular support structure defined by a planar base, a planar rear panel and a planar front panel, the front and rear panels adjoined along an upper edge, the front panel having a linear series of apertures extending along an intermediate length thereof, the rear panel having a corresponding series of apertures extending along an intermediate length thereof;

a plurality of stacked information cards supported along an intermediate area of the planar front panel, the cards each having a linear series of apertures provided adjacent to an upper card edge, the card apertures corresponding to and aligned with the front and rear panel apertures, each card having information printed thereon pertaining to a location within an office environment;

a spiral binder extending through the apertures in the front and rear panels and the information cards, such that the information cards are carried by the spiral rod;

an erasable marking surface disposed on a first area of the front panel adjacent to the intermediate surface thereof;

a marker carried by said apparatus along an upper edge of the marking surface;

a clock face disposed upon an opposite second area of the front panel adjacent to the intermediate front panel area; and a pair of non-electronic manually-adjustable pivoting clock hands secured to the front panel and disposed over the clock face.

* * * * *